US005713785A

United States Patent [19]

Nishio

[11] Patent Number: 5,713,785

[45] Date of Patent: Feb. 3, 1998

[54] VACUUM TYPE PORTABLE SANDER

[75] Inventor: Takuji Nishio, Tokyo, Japan

[73] Assignee: Linax Co., Ltd., Japan

[21] Appl. No.: 784,056

[22] Filed: Jan. 17, 1997

[51] Int. Cl.[6] ..... B24B 55/04

[52] U.S. Cl. ..... 451/451; 125/9; 409/137; 144/252.1; 451/456; 451/441

[58] Field of Search ..... 451/340, 354, 451/357, 359, 353, 344, 441, 451, 456, 282, 259; 125/9; 83/940, 941, 100; 409/82, 134, 137; 144/251.1, 251.2, 252.1, 118, 119.1

[56] References Cited

U.S. PATENT DOCUMENTS

| | | | |
|---|---|---|---|
| 1,681,648 | 8/1928 | Root | 451/359 |
| 3,722,147 | 3/1973 | Brenner | 451/359 |
| 3,882,644 | 5/1975 | Cusumano | 451/456 |
| 3,935,678 | 2/1976 | Marton | 451/456 |
| 3,969,856 | 7/1976 | Zerrer | 451/451 |
| 4,135,334 | 1/1979 | Rudiger | 451/456 |
| 4,242,839 | 1/1981 | Armbruster et al. | 451/357 |
| 4,462,381 | 7/1984 | Fushiya et al. | 451/359 |
| 4,622,782 | 11/1986 | Roestenberg | 451/359 |
| 4,905,421 | 3/1990 | Maier et al. | 451/359 |
| 5,125,190 | 6/1992 | Buser et al. | 451/456 |
| 5,439,413 | 8/1995 | Lagler | 451/357 |

*Primary Examiner*—James G. Smith
*Assistant Examiner*—Derris H. Banks
*Attorney, Agent, or Firm*—Andrus, Sceales, Starke & Sawall

[57] ABSTRACT

A vacuum type portable sander for exhausting dust emitted during the sanding, and housed within a lid-shaped shield which encloses the rotary disc. The shield has a body of hard material provided with an exhaust outlet, and at the bottom edge has a skirt member to contact the work surface during sanding. This skirt member is installed to move freely up and down along the outer periphery of the body. The main body has a resilient member in order to make the skirt member rebound onto the work surface during sanding. The skirt member is installed suspended from a hook on the upper part of the main body. The skirt member of this invention as configured above, can move up and down in response to irregular portions on the work surface and the interior of the shield therefore maintains a good seal to match variations on the work surface. The skirt member of this invention sustains damage due to wear from contact with work surfaces such as walls. When the skirt member consequently becomes unusable, the main sander body can be left as is, and only the skirt member need be replaced.

6 Claims, 7 Drawing Sheets

VACUUM TYPE PORTABLE SANDER

BACKGROUND OF THE INVENTION

1. Field of the Invention

This invention relates in general to a portable sander for sanding of surfaces such as concrete walls and floors and more specifically relates to a portable sander that sands while also suctioning up the resulting powder from the surface.

2. Description of the Related Art

Grinders of the prior art have been proposed such as mentioned in U.S. Pat. No. 5,125,190. In this example of the prior art, the rotary disc is enclosed by an upper shield and is formed with a flexible portion having a skirt. In this rotary sander of the prior art, the shield has a flexible portion so the interior of the shield maintains a good seal even with variations in the work surface and a steady suction can be ensured.

However in sanders of this type, the bottom edge of the shield is prone to wear due to rubbing against the surface being sanded, and also tends to become slack on the inner ends and easily cut by the rotating disc. Another drawback is that when sanding surfaces such as walls, the periphery of the shield may strike the wall sustaining damage.

A sander of this type therefore, not only fails to maintain a good seal between the inside of the shield and the work surface, but the shield may become damaged, making a different configuration of shield desirable in order to reduce the shield repair costs.

In the above mentioned sander of the prior art, the entire shield must be replaced when damaged. Accordingly, sanders of this type have problems in maintaining a good seal between the shield and the work surface with resultant high costs for repairs due to damage to the shield.

SUMMARY OF THE INVENTION

This invention is a suction type portable sander able to exhaust the inside of the lid-shaped shield that encloses the rotating disc.

The shield consists of a main body made of hard material having pores and is also formed with a skirt-shaped member installed to be able to freely move up and down along the outer circumference of the main body and the bottom edge of this skirt member contacts the work surface during sanding.

The main body is made of resilient material in order to make the skirt member rebound onto the work surface during sanding. The skirt member is installed to engage with the hook on the upper part of the main body.

The skirt member of the sander of this invention, being formed as described above, can move up and down when irregularities (convex or concave portions) are present on the work surface and the interior of the shield can therefore maintain a good seal to match variations in the work surface.

In this invention, the skirt member contacts the work surface and the outer circumference of the skirt encounters obstructions such as walls. The skirt member of this invention therefore incurs damage due to abrasion. In such cases however, removing the skirt member from the main body for replacement is sufficient. There is no need to replace the entire shield with the consequent advantage that maintenance costs are reduced.

DESCRIPTION OF THE PREFERRED EMBODIMENTS

Next, a preferred embodiment of this invention will be described while referring to the appended drawings.

Figure 1:
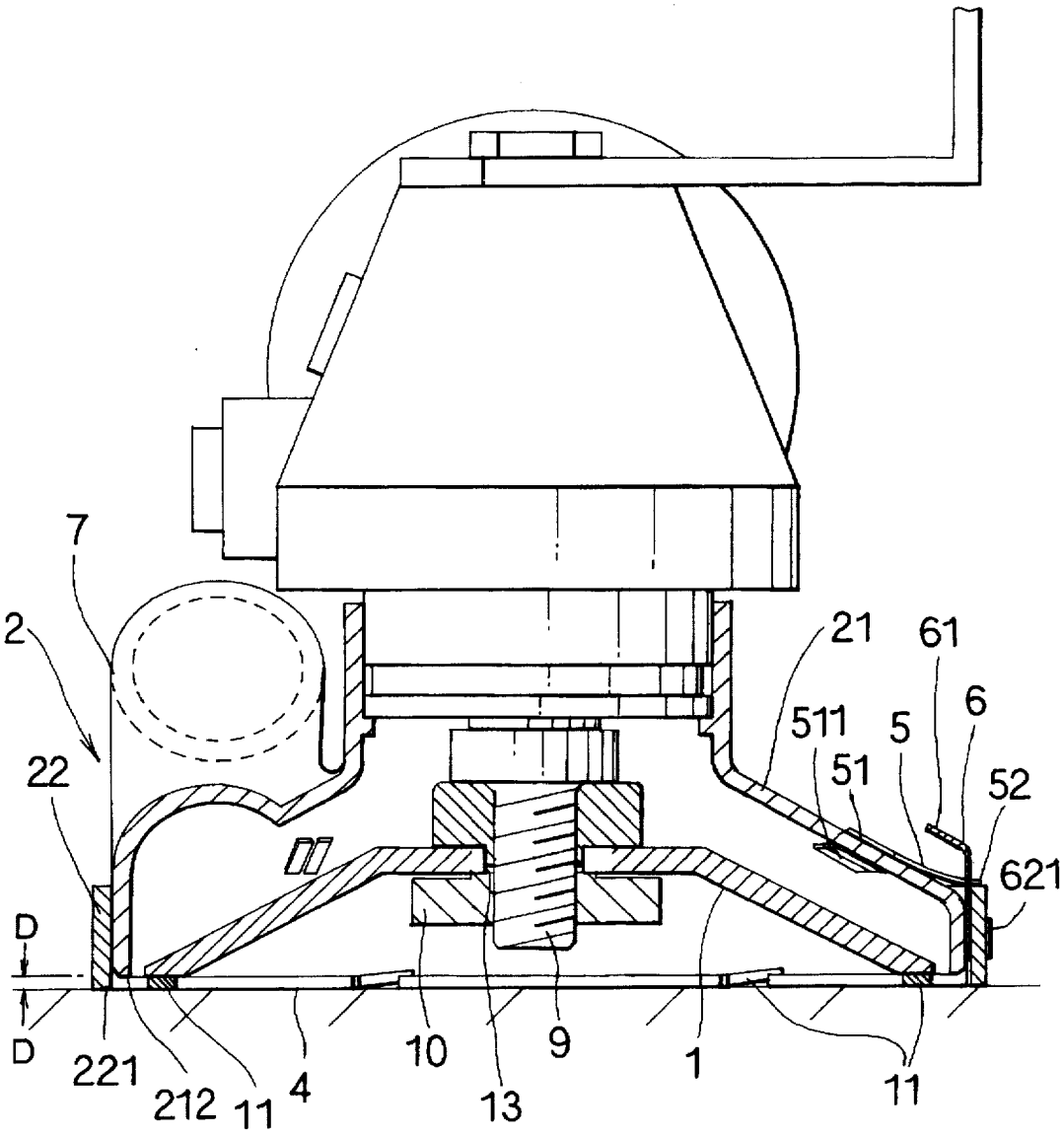
FIG. 1 is a cross sectional view taken along line I—I in FIG. 2, of a portion of a typical embodiment of this invention.
Figure 7:
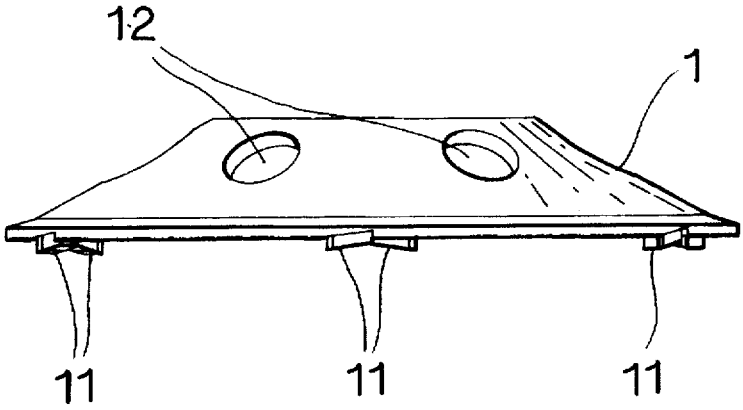
FIG. 7 is a front view of the rotary disc.
Figure 8:
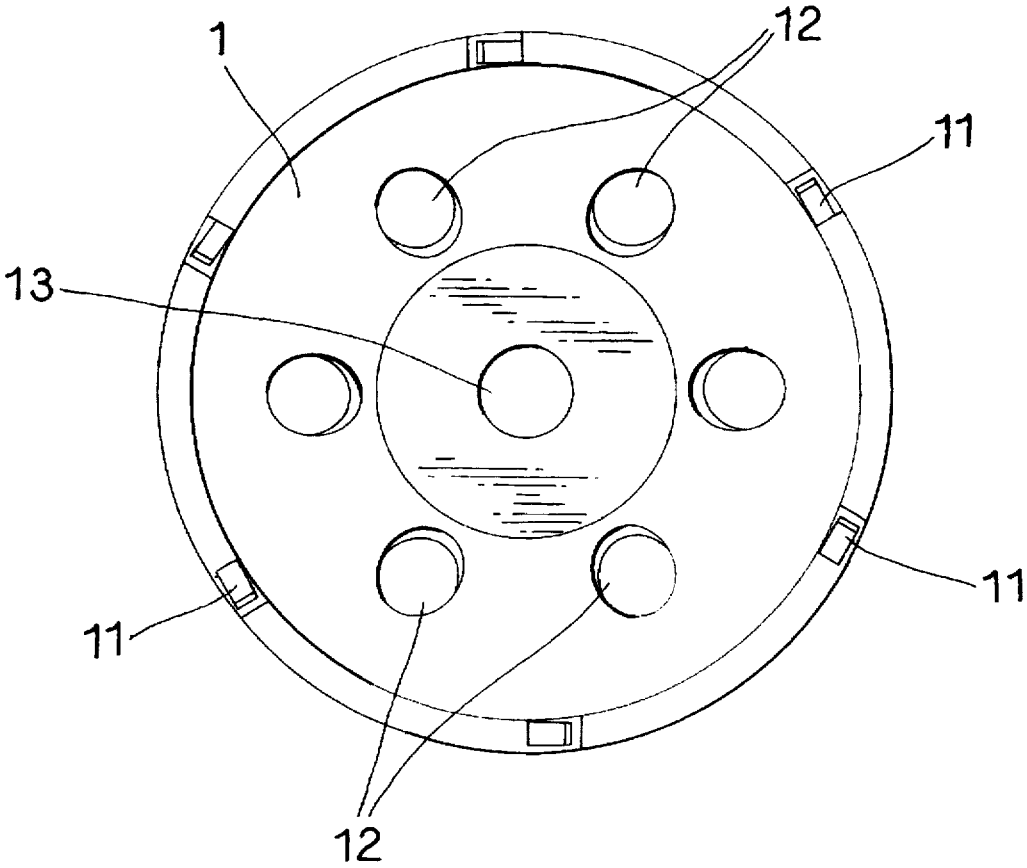
FIG. 8 is a bottom view of the rotary disc.

Numeral 1 in FIG. 1 denotes a rotary disc used as the rotary cutter. This rotary disc 1 is formed in the shape of an inverted saucer as shown in FIGS. 7 and 8. This rotary disc 1 is also provided on the lower surface with a plurality of cutters 11 having a chip shape and spaced at equivalent intervals on the disc, as well as a plurality of exhaust holes 12 for evacuating the dust emitted during sanding. The chip-shaped cutter 11 can be made for instance of sintered diamonds. In the rotary disc 1, a rotating axis 9 passes through a hole 13 as shown in FIG. 1, and the rotary disc 1 is fastened to the rotating axis 9 by a nut 10.

Figure 2:
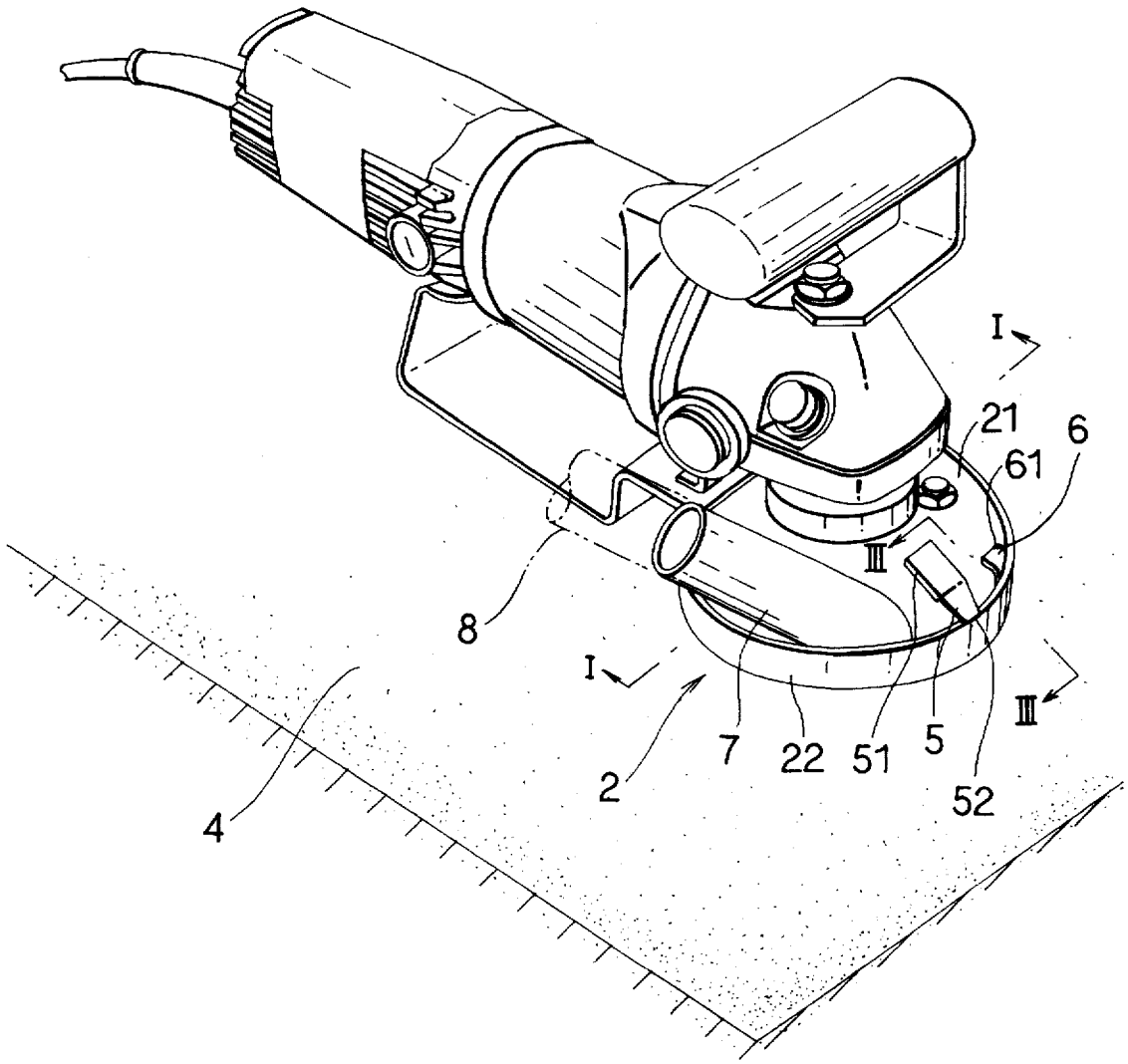
FIG. 2 is a perspective view of the sander of this invention.
Figure 3:
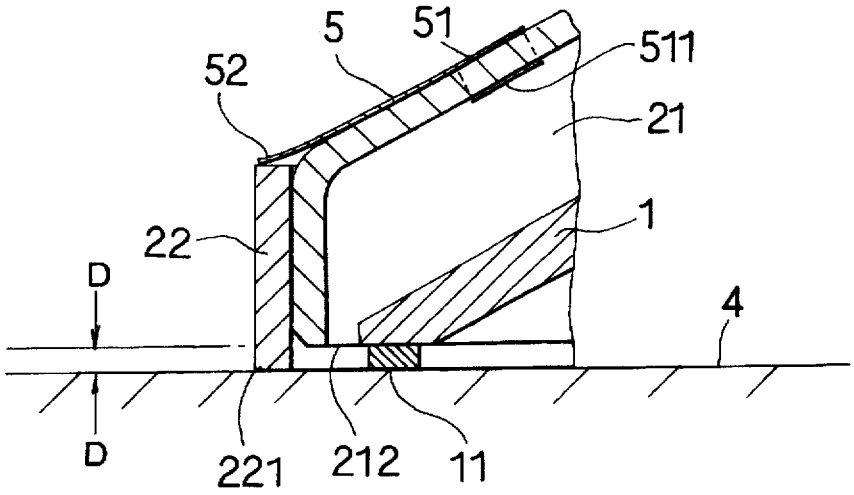
FIG. 3 is an enlarged fragmentary view taken along line III—III in FIG. 2.

The rotating disc 1 is covered by a lid-shaped shield 2 as shown in FIGS. 1 and 2. This shield 2 is comprised of a body 21 of hard material provided with exhaust outlet 7 and a skirt member 22 formed of a flexible material such as of synthetic rubber.

The exhaust outlet 7 as shown in FIG. 2 is joined to a suction hose 8 formed for instance with a cylindrical shape.

Figure 4:
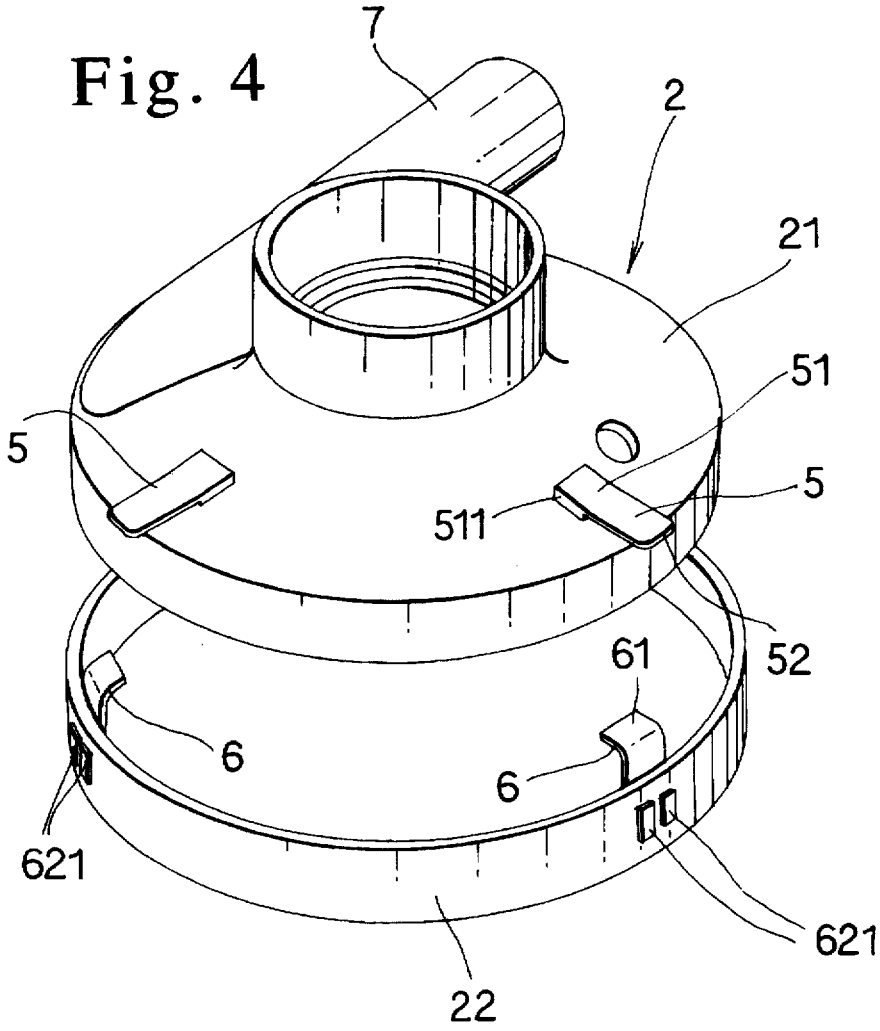
FIG. 4 is an exploded perspective view showing the main body and the skirt-shaped member.
Figure 5:
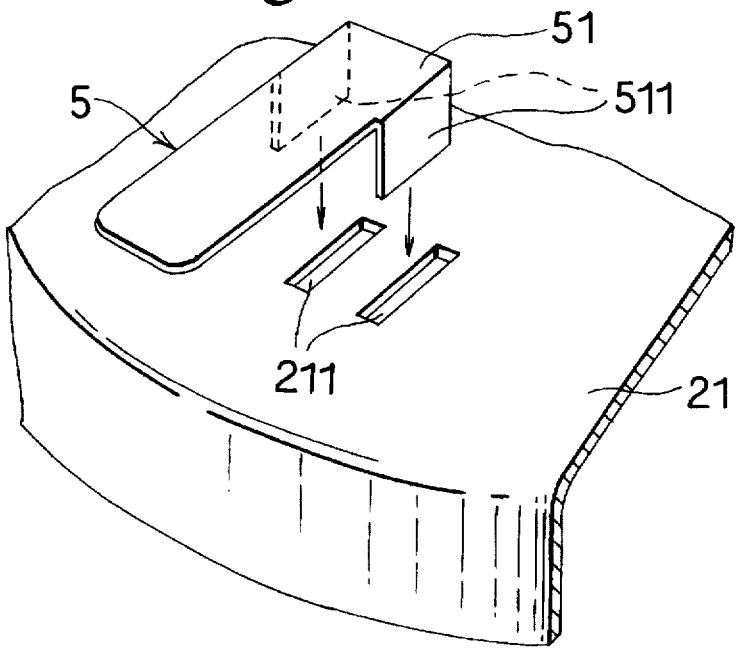
FIG. 5 is an exploded perspective view showing an essential portion of the main body and the resilient member.

The body 21 of this embodiment is formed of a hard plastic material. This body 21 can also be formed with a resilient member 5 for rebounding the skirt member 22 onto a work surface 4 during sanding. In this embodiment, a plate spring material is utilized as this resilient member 5, the base edge 51 of which is comprised of a pair of bent pieces 511 on left and right as shown in FIGS. 4 and 5. The bent pieces 511 are inserted into the pair of slits 211 formed on the upper surface of the body 21 and can then for instance be bent inwards to secure the plate spring material used as the resilient member 5 to the body 21.

This plate spring material used as the resilient member 5 has a tip 52 installed to protrude outwards in a shield shape from the upper surface of the body 21 as shown in FIGS. 1 and 2 and elsewhere. In this embodiment, a total of three of these plate spring material used as the resilient member 5 are installed around the periphery of the body 21 as shown in FIG. 4.

An extremely short, cylindrical shape for the skirt member 22 is formed by setting dimensions for example of a 110 mm diameter (outer) height of 15 mm, and thickness of approximately 2 mm. A slight gap D is opened between the skirt bottom 221 and the bottom 212 of the body 21, this skirt member 22 is installed to move freely up and down on the outer periphery of the body 21, so that the skirt bottom 221 will make contact with the work surface 4 as shown in FIGS. 1 and 2. In this embodiment, the gap D is set to the same height as the cutter 11.

Figure 6:
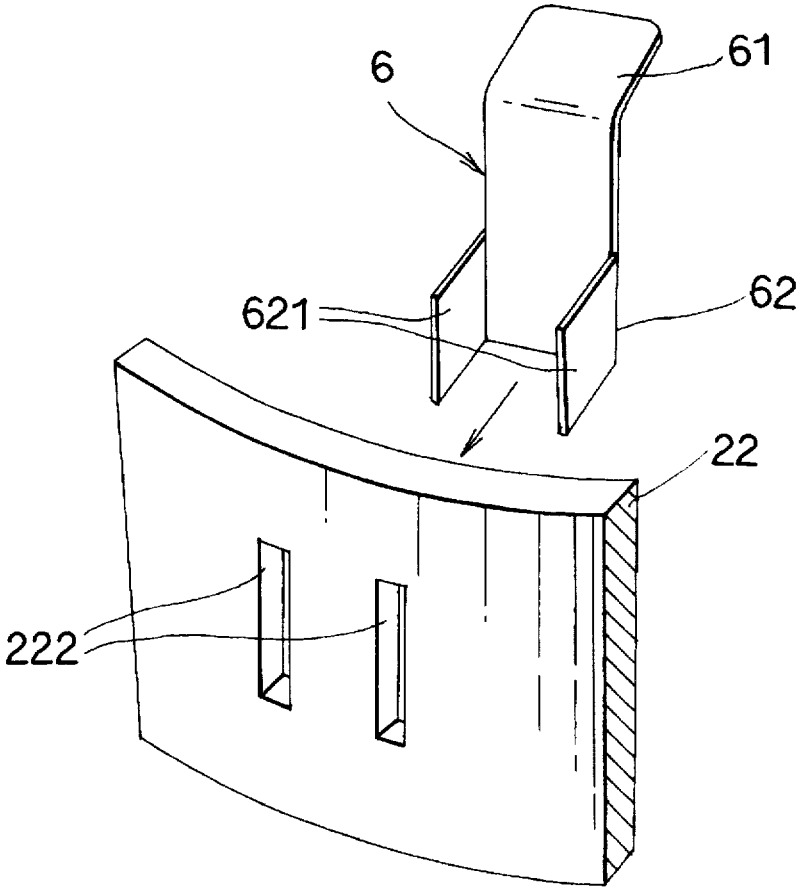
FIG. 6 is an exploded perspective view showing an essential portion of the skirt-shaped member and the hook.

The skirt member 22 is also provided with a hook 6 for engaging the upper surface of the body 21 and is installed suspended from the body 21. As shown in FIG. 6, the upper piece 61 of the hook 6 may for example be made of thin metal plate bent to match the slope of the upper surface of the body 21. A lower piece 62 of the hook 6 is provided with a pair of bent pieces 621 on the left and right.

The slits 222 of FIG. 6 are formed on the left and right of the skirt member 22. The pair of bent pieces 621 on the hook 6 are inserted into these slits 222 into the skirt member 22 and may for instance be bent inwards to fasten to the skirt member 22.

In this embodiment, a total of three of these hooks 6 are formed at equally spaced intervals on the periphery of the skirt member 22 as shown in FIG. 4. The effect of this invention will be described next.

In this invention, when the skirt bottom 221 of the skirt member 22 contacts the work surface 4, the upward and downward force on the skirt member 22 is received by the resilient member 5. Therefore, during sanding, the skirt member 22 is pressed down on the work surface 4 by means of the pressure from the resilient member 5. The effect of this invention ensures that the skirt member 22 moves flexibly up and down so that even if variations are present in the work surface 4 a good seal is maintained with the interior of the shield 2.

Also in this invention, the skirt member 22 engages with the upper surface of the body 21 by means of the hook 6 so that the skirt member 22 will not fall away from the body 21 at times such as when being carried.

When the skirt bottom 221 of the skirt member 22 of this invention becomes worn or the periphery damaged after striking a surface such as a wall, the operator would first press the hook outwards to release the hook engagement with the upper surface of the body 21, and then pull the skirt member 22 downwards, away from the body 21, and replace the skirt 22 with a new part.

Thus in the above process in this invention, the gap D is preferably set to the same height as the cutter 11. The skirt member 22 makes contact over a wide surface area with the outer periphery of the body 21 so that inward bending of the skirt bottom 221 of the skirt member 22 is definitely avoided and the skirt bottom 221 is not cut by the rotary disc 1.

Also preferable, is that the skirt member 22 of this invention be made of rubber such as synthetic rubber. In this case, since the shape of the skirt member 22 is changed by following along the work surface 4, the sealing of the interior of the shield 2 improves and the suction force improves by the same amount, yielding the advantage that sander need not be strongly pressed down onto the work surface.

Figure 9:
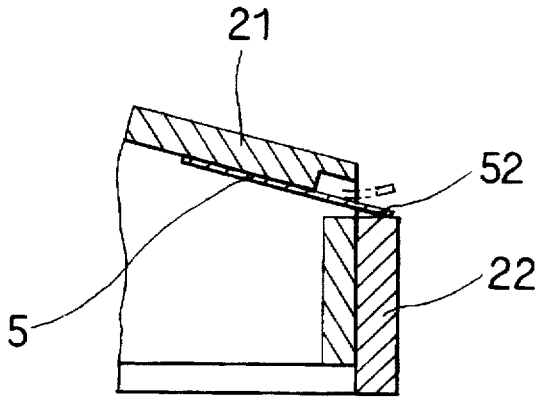
FIG. 9 is a longitudinal view showing an essential portion of other resilient members while installed.

The spring plate used as the resilient member 5 of this invention as shown in FIG. 9, can also be installed on the inside of the upper surface of the body 21, with the tip 52 exposed to the outside. In this case, the tip 52 of the spring plate is not exposed to the outside unlike the previous example, thus yielding the advantage that the position is good which helps prevent corrosion.

Figure 10:
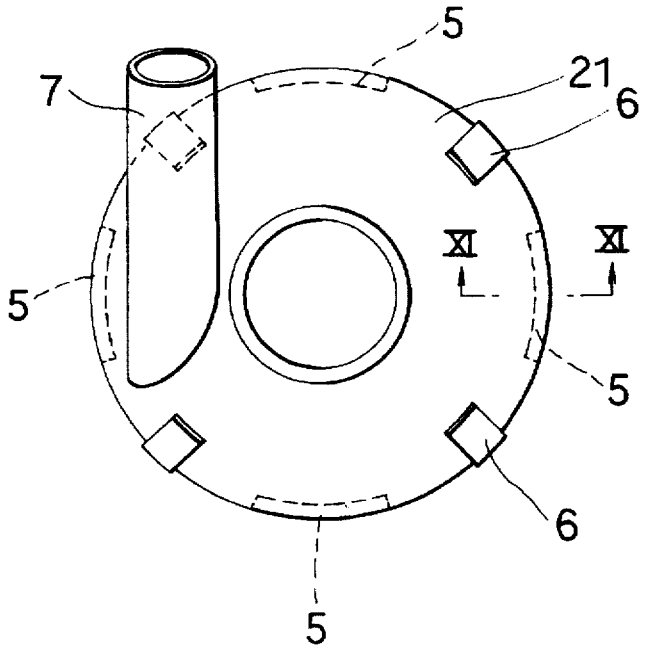
FIG. 10 is a flat view of the main body showing the installation position of the resilient member when made of rubber.
Figure 11:
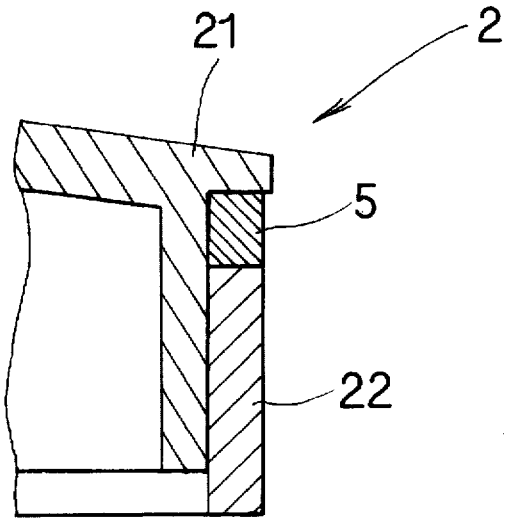
FIG. 11 is an enlarged fragmentary view taken along line XI—XI of FIG. 10.

The resilient member 5 of this invention need not be limited to the above example and other types of rubber material such as synthetic rubber may be used. The rubber material used as the resilient member 5 may be installed at an upper position on the outer periphery of the body 21 as shown in FIGS. 10 and 11. In such cases, a plurality of resilient members 5 of rubber may be installed at fixed intervals on the body 21 as shown in FIG. 10 or may also be provided in a continuous ring shape along the periphery of the body 21.

Figure 12:
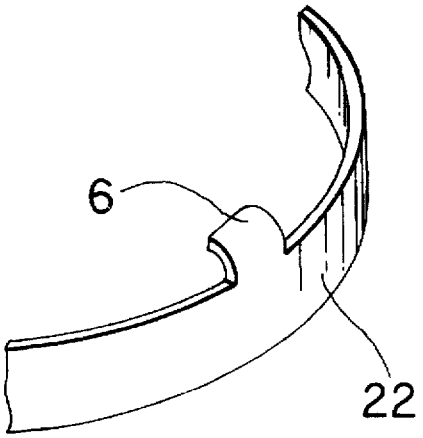
FIG. 12 is a perspective view showing an essential portion of another embodiment of the skirt member.

The hook 6 of this invention may also be formed in a shape integrated with the skirt member 22 as shown in FIG. 12.

The shape and type of the rotary disc 1 of this invention may be selected as needed, and the shape and quantity of the dust exhaust holes 12 and the cutter 11 can be chosen to match the particular work surface 4.

What is claimed is:

1. A vacuum type portable sander for exhausting the interior of a lid-shaped shield during sanding and said shield encloses the rotary disc wherein;

said shield is formed with a body of hard material provided with an exhaust outlet, and with a skirt member installed at the bottom edge of the outer periphery of the body to freely move up and down when contacting the work surface during sanding and, said body is provided with a resilient member to make the skirt member rebound onto the work surface during sanding and, said skirt member is installed suspended from a hook on the upper part of the main body.

2. A vacuum type portable sander according to claim 1 wherein a rotary disc is formed in an inverted saucer shape with a plurality of chip shaped cutters spaced at equivalent intervals on the lower surface of the disc, as well as a plurality of exhaust holes for evacuating the dust emitted during sanding.

3. A vacuum type portable sander according to claim 1 wherein the skirt member is made of rubber.

4. A vacuum type portable sander according to claim 1 wherein a plate spring material is a resilient member, the base edge of which is secured to the upper surface of the body and the tip of which protrudes in a shield shape from the upper surface of the body.

5. A vacuum type portable sander according to claim 1 wherein the resilient member is rubber and this rubber is installed at the upper position on the outer periphery of the body.

6. A vacuum type portable sander according to claim 2 wherein the gap between the bottom of the skirt member and the bottom of the body is set at the height of the chip-shaped cutter.

* * * * *